US005781826A

United States Patent [19]

Inomata

[11] Patent Number: 5,781,826

[45] Date of Patent: Jul. 14, 1998

[54] IMAGE FORMING APPARATUS WITH MOVABLE MEMBER SHIFTABLE AT DIFFERENT SPEEDS

[75] Inventor: Mitsugu Inomata, Kawasaki, Japan

[73] Assignee: Canon Kabushiki Kaisha, Tokyo, Japan

[21] Appl. No.: 758,814

[22] Filed: Dec. 4, 1996

Related U.S. Application Data

[63] Continuation of Ser. No. 350,097, Nov. 29, 1994.

[30] Foreign Application Priority Data

Nov. 30, 1993 [JP] Japan ..... 5-325819

[51] Int. Cl.[6] ..... G03G 21/00

[52] U.S. Cl. ..... 399/53; 399/66; 399/298

[58] Field of Search ..... 399/38, 159, 66, 399/298, 223, 53

[56] References Cited

U.S. PATENT DOCUMENTS

| | | | |
|---|---|---|---|
| 4,084,899 | 4/1978 | Ishida et al. . | |
| 4,110,031 | 8/1978 | Ebi et al. . | |
| 4,591,261 | 5/1986 | Saruwatari et al. . | |
| 4,705,386 | 11/1987 | Ogita et al. . | |
| 4,723,146 | 2/1988 | Kasahara . | |
| 4,952,978 | 8/1990 | Ueda et al. . | |
| 5,260,751 | 11/1993 | Inomata | 355/271 |
| 5,436,647 | 7/1995 | Kasahara . | |

OTHER PUBLICATIONS

*Patent Abstracts of Japan*, vol. 18, No. 36, p. P1678, for 05-265358, Oct. 15, 1993.

*Patent Abstracts of Japan*, vol. 17, No. 224, p. P1530, for 04-355467, Dec. 9, 1992.

Patent Abstracts of Japan, vol. 13, No. 303 (P896), Published Jul. 12, 1989 for JP-A-01-78267, Mar. 23, 1989.

Patent Abstracts of Japan, vol. 18, No. 165 (E1527), Published Mar. 18, 1994 for JP-A-05-336331, Dec. 17, 1993.

*Primary Examiner*—R. L. Moses

*Attorney, Agent, or Firm*—Fitzpatrick, Cella, Harper & Scinto

[57] ABSTRACT

An image forming apparatus comprises an image bearing member for bearing an image, an image forming means for forming the image on the image bearing member, a movable member which can be shifted along a transfer station of the image bearing member and onto which a first image and a second image on the image bearing member are successively transferred in a superimposed fashion, and a shifting speed switching means for switching a shifting speed of the movable member between a first shifting speed during a transferring operation and a second shifting speed slower than the first shifting speed, after the first image was transferred to the movable member and before the second image is transferred onto the movable member.

24 Claims, 9 Drawing Sheets

IMAGE FORMING APPARATUS WITH MOVABLE MEMBER SHIFTABLE AT DIFFERENT SPEEDS

This application is a continuation of application No. 08/350,097, filed Nov. 29, 1994.

BACKGROUND OF THE INVENTION

1. Field of the Invention

The present invention relates to an image forming apparatus wherein images formed on an image bearing member are successively transferred onto a movable member in a superimposed fashion, and an image forming apparatus wherein a plurality of images are successively formed on an image bearing member in a superimposed fashion.

2. Related Background Art

In image forming apparatuses such as copying machines, laser beam printers and the like, as methods for forming a multi-color image, a multi-transfer method in which toner images formed on a photosensitive member are successively superimposed during a transferring operation, and a multi-development method in which latent images on a photosensitive member are successively developed to form a superimposed toner image are already known. However, in both of these methods, for example, a time period during which an image is not formed on the photosensitive member is required because of a developing unit switching operation for successively bringing a plurality of different color developing units to an operating position of the photosensitive member where the selected developing unit is opposed to a latent image to be developed.

Accordingly, in the multi-development method, it is necessary to maintain a certain distance between a trailing end of an image and a tip end of a next image in a shifting direction of the photosensitive member, thereby making the photosensitive member bulky.

Further, in the multi-transfer method, it is necessary to maintain a certain distance between a trailing end of an image and a tip end of a next image in a shifting direction of a transfer drum or an intermediate transfer member to align a tip end formed on the photosensitive drum with a tip end of an image on the transfer drum or the intermediate transfer member, thereby making the transfer drum or the intermediate transfer member bulky.

In addition, if the transfer drum becomes bulky, a peripheral length of a portion on which a transfer material is not born or supported will be increased. Accordingly, in this case, when a single color image is successively formed on a predetermined number of transfer material, respectively, by inputting a single image formation start signal from an external device to an image forming apparatus, i.e., when the switching operation for the developing units is not required, since the peripheral length of the portion on which a transfer material is not supported is long, the time required for forming the same image on the plurality of recording materials is greatly increased.

SUMMARY OF THE INVENTION

An object of the present invention is to make an image forming apparatus compact.

Another object of the present invention is to make a movable member onto which an image formed on an image bearing member is transferred compact.

A further object of the present invention is to make an image bearing member compact.

A still further object of the present invention is to minimize a time required for forming an image on a plurality of transfer materials.

The other objects and features of the present invention will be apparent from the following detailed explanation referring to the accompanying drawings.

DETAILED DESCRIPTION OF THE PREFERRED EMBODIMENTS (First Embodiment)

Figure 9:
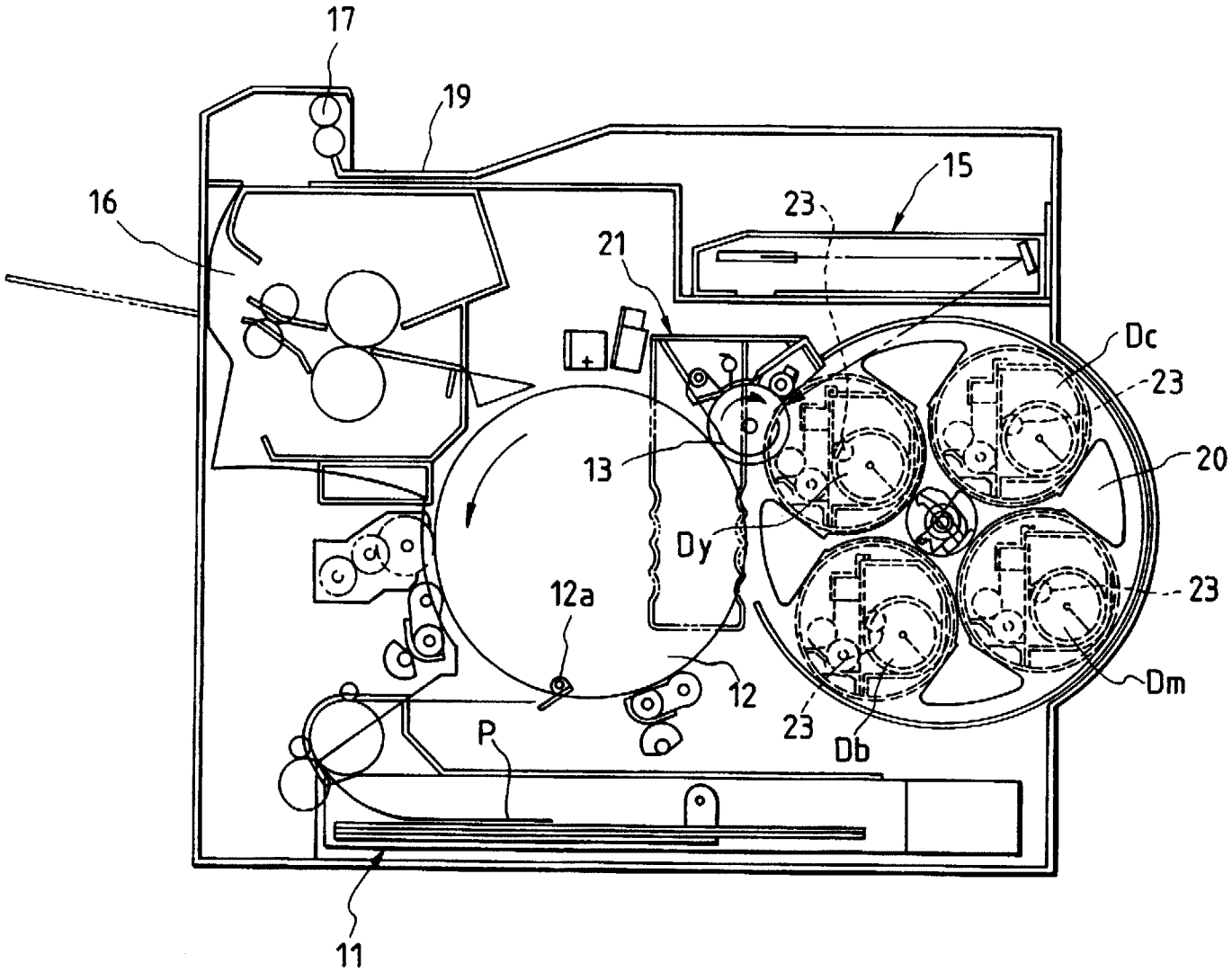
FIG. 9 is a schematic sectional view of a multi-color image forming apparatus of multi-transfer type.

An image forming apparatus of multi-transfer type according to a first embodiment of the present invention is schematically shown in FIG. 9.

A tip end of a transfer material P supplied from a sheet supply portion 11 is gripped by grippers 12*a* of a transfer drum 12 and then the entire transfer material is wound around an outer peripheral surface of the transfer 12 and held there. On the other hand, a latent image corresponding to a predetermined color (for example, yellow) is formed, by an optical unit 15, on a surface of an image bearing member 13 uniformly charged by a charger (not shown). The latent image is developed with yellow toner by a developing unit Dy to form a toner image. The yellow toner image formed on the image bearing member 13 is transferred onto the transfer material P born on the transfer drum 12.

A series of image forming processes similar to the above-mentioned image forming processes regarding the yellow color are repeated with respect to the other three colors, i.e., cyan, magenta and black by using developing units Dc, Dm, Db and the like, with the result that the yellow, cyan, magenta and black color toner images are transferred onto the transfer material P supported on the transfer drum 12 in a superimposed fashion. Thereafter, the transfer material P is separated from the transfer drum 12. The separated transfer material is sent to a fixing device 16, where the toner images are fixed to the transfer material. Then, the transfer material is discharged onto a sheet discharge tray 19 by means of a pair of discharge rollers 17. On the other hand, residual toner remaining on the image bearing member 13 is removed from the image bearing member by a cleaning unit 21 for preparation for next image formation.

By the way, each of the developing units Dy, Dc, Dm and Db is provided at its both ends with rotation shafts 23 so that each developing unit is held by a developing unit switching mechanism 20 for rotation around the rotation shafts of the unit. In a developing operation, a selected developing unit (for example, the yellow developing unit Dy when the latent image corresponding to the yellow is developed) is brought to a developing station to be opposed to the image bearing member 13.

When the yellow developing unit Dy is switched to the cyan developing unit Dc, first of all, after a developing roller in the yellow developing unit Dy is stopped (completion of the development of the latent image with the yellow toner), the developing unit switching mechanism 20 is driven (rotated) so that the yellow developing unit Dy is retarded from the developing station and then the cyan developing unit Dc is positioned at the developing station. Then, a developing roller of the cyan developing unit Dc is rotated in a predetermined manner. In this way, the switching operation for the developing units 20 is finished. Incidentally, in explanation described hereinbelow, the term "switching time $T_0$ for developing units" means a time period from the stoppage of the developing roller of the developing unit for a certain color (yellow in the above-mentioned case) after the development with the certain color is finished to the start of the predetermined rotation of the developing roller of the developing unit for a next color (cyan in the above-mentioned case) after the developing unit is positioned at the developing station.

By the way, there is a danger of distortion of an image due to shock, vibration or the like generated by the developing unit switching operation. To avoid this, in the illustrated embodiment, the developing unit switching operation is not effected when the latent image is being formed by the optical system 15 and when the toner image is being transferred onto the transfer material P.

Figure 1:
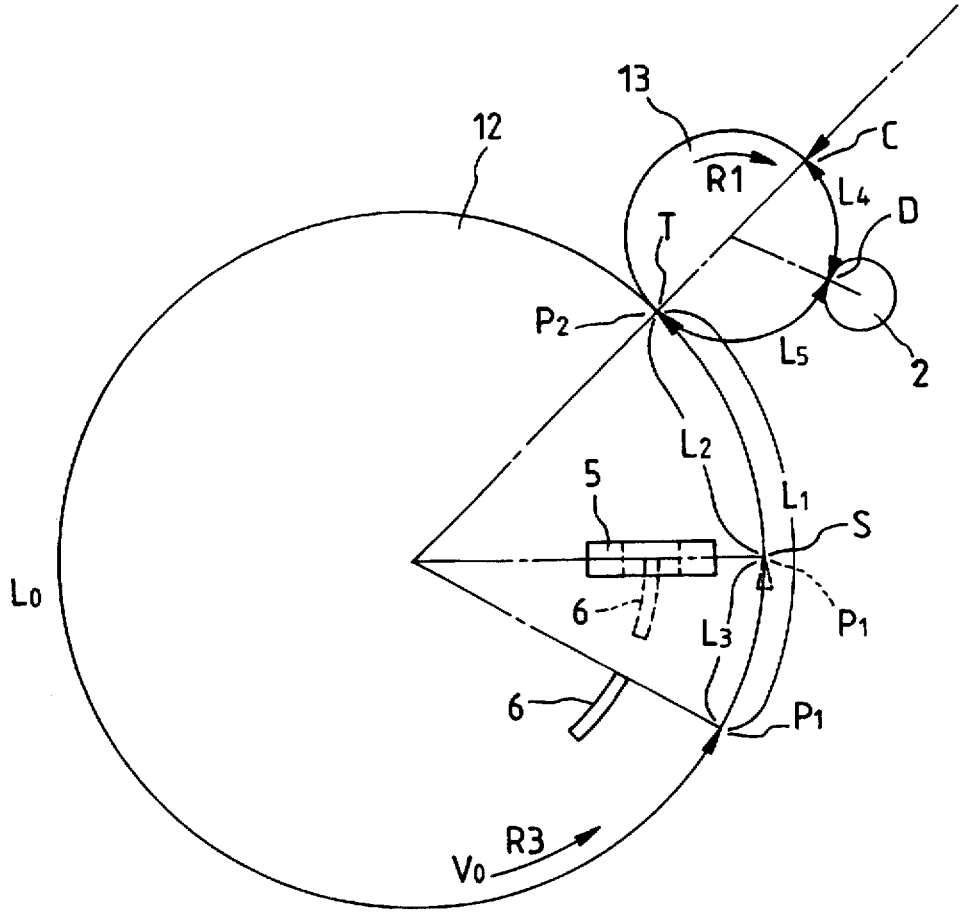
FIG. 1 is a sectional view for explaining operations of an image bearing member, a developing roller and a transfer drum, according to a first embodiment of the present invention.

FIG. 1 is an enlarged view of the image bearing member 13, the developing roller 2 of one of the developing units Dy, Dc, Dm, Db and the transfer drum (transfer material bearing member) 12.

Now, these elements will be fully explained. The image bearing member (photosensitive member) 13 is a drum-shaped member supported for rotation in a direction shown by the arrow R1. Around the image bearing member, there are arranged a latent image forming station C where the exposure is effected, the above-mentioned developing station D where the image bearing member is contacted with the developing roller 2, and a transfer station T where the image bearing member is contacted with the transfer drum 12, in order along the rotational direction of the image bearing member. Further, an image tip end detecting position S is associated with the transfer drum 12 supported for rotation in a direction shown by the arrow R3. An image tip end detection sensor 5 of light permeable type is secured to a body of the image forming apparatus at the image tip end detecting position S so that the sensor can detect a flag (shield plate) 6 which is rotated together with the transfer drum 12. The flag 6 is a member for shielding the image tip end detection sensor 5 positioned at one side of the transfer drum 12, and a shielding station is disposed at a position spaced apart from a tip end of the transfer material P held on the transfer drum 12 by a predetermined distance. The transfer material P is held on the transfer drum 12 in such a manner that an image tip end (tip end of the transfer material) $P_1$ is aligned with the flag 6 in a circumferential direction of the transfer drum 12.

The stations C, D, T and S are spatially immovable, i.e., stationary regardless of the rotations of the image bearing member 13, developing roller 2 and transfer drum 12. On the other hand, the image tip end (tip end of the transfer material P) $P_1$ and an image trail end $P_2$ of the transfer material P wound around and held on the transfer drum 12 are shifted in the rotational direction R3 as the transfer drum 12 is rotated.

Next, distances between the stations will be explained. When a peripheral length of the transfer drum 12 is L and a length of the transfer material P wound around and held on the transfer drum in a conveying direction of the transfer material P is $L_0$ ($L>L_0$), a distance between $L_1$ the image tip end $P_1$ and the image trail end $P_2$ of the transfer material P is represented by an equation $L_1=L-L_0$. Among the distance $L_1$, when a distance between the image tip end detecting station S and the transfer station T is $L_2$, this distance $L_2$ is set to be equal to the sum of a distance $L_4$ between the latent image forming station C on the image bearing member 13 and the developing station D and a distance $L_5$ between the developing station D and the transfer station T ($L_2=L_4+L_5$). With this arrangement, when the latent image formation on the image bearing member 13 is started at the latent image forming station C as soon as the fact that the image tip end $P_1$ on the transfer drum 12 rotated in the direction R3 passes through the image tip end detecting station S is detected (i.e., the flag 6 is detected by the image tip end detection sensor 5), a tip end of the latent image (tip end of the toner image) reaches the transfer station T as soon as the image tip end $P_1$ reaches the transfer station T. That is to say, in the transfer station T, the toner image is transferred onto the transfer material P in such a manner that the tip end of the toner image is aligned with the image tip end $P_1$ of the transfer material.

By the way, regarding the peripheral surface L of the transfer drum 12, when a relation between the latent image forming process, developing process and transferring process is considered, at least the latent image forming process is effected (the developing process is partially effected at the same time) while the transfer drum 12 is being rotated by the distance $L_2$, and at least the transferring process is effected (the latent image forming process and developing process are partially effected), while the transfer drum 12 is being rotated by the distance $L_0$ corresponding to the length of the transfer material P. Accordingly, as mentioned above, if the developing unit switching operation is effected without interference with the latent image forming process and the transferring process, a portion where both latent image forming process and the transferring process are not effected must be provided on the periphery of the transfer drum 12 (This portion is referred to as "switching length" $L_3$ hereinafter). As apparent from FIG. 1, the switching length $L_3$ is represented by the following equation (1):

$$\begin{aligned} L_3 &= L_1 - L_2 \\ &= (L - L_0) - (L_4 + L_5) \\ &= L - (L_0 + L_4 + L_5) \end{aligned} \quad (1)$$

On the other hand, when the time required for switching the developing units is $T_0$ (constant) and a process speed of the image bearing member 13 and the transfer drum 12

(shifting speed of the transfer material P) is $V_0$, a condition for switching the developing units while the latent image forming process and the transferring process are not being effected, i.e., a condition that the developing unit switching operation is completed before the transfer drum 12 is rotated by the distance $L_3$ must satisfy the following relation:

$$L_3/V_0 \geqq T_0 \quad (2)$$

Thus, when the process speed $V_0$ is constant, the length $L_3$ is required to be greater than a predetermined length ($V_0 \times T_0$). By the way, in the above equation (1), since the lengths $L_0$, $L_4$, $L_5$ are determined by the design of the body of the image forming apparatus and the restriction in design, if the distance or length $L_3$ is increased, the peripheral length L of the transfer drum 12 must be increased, thereby making the image forming apparatus bulky.

In consideration of the above, in the illustrated embodiment, a process speed $V_1$ of the transfer drum 12 while this drum is being rotated by the switching length $L_3$ is set to be slower than the above process speed $V_0$ ($V_0 > V_1$) and the switching length $L_3$ is shortened accordingly, thereby making the image forming apparatus compact.

Figure 2:
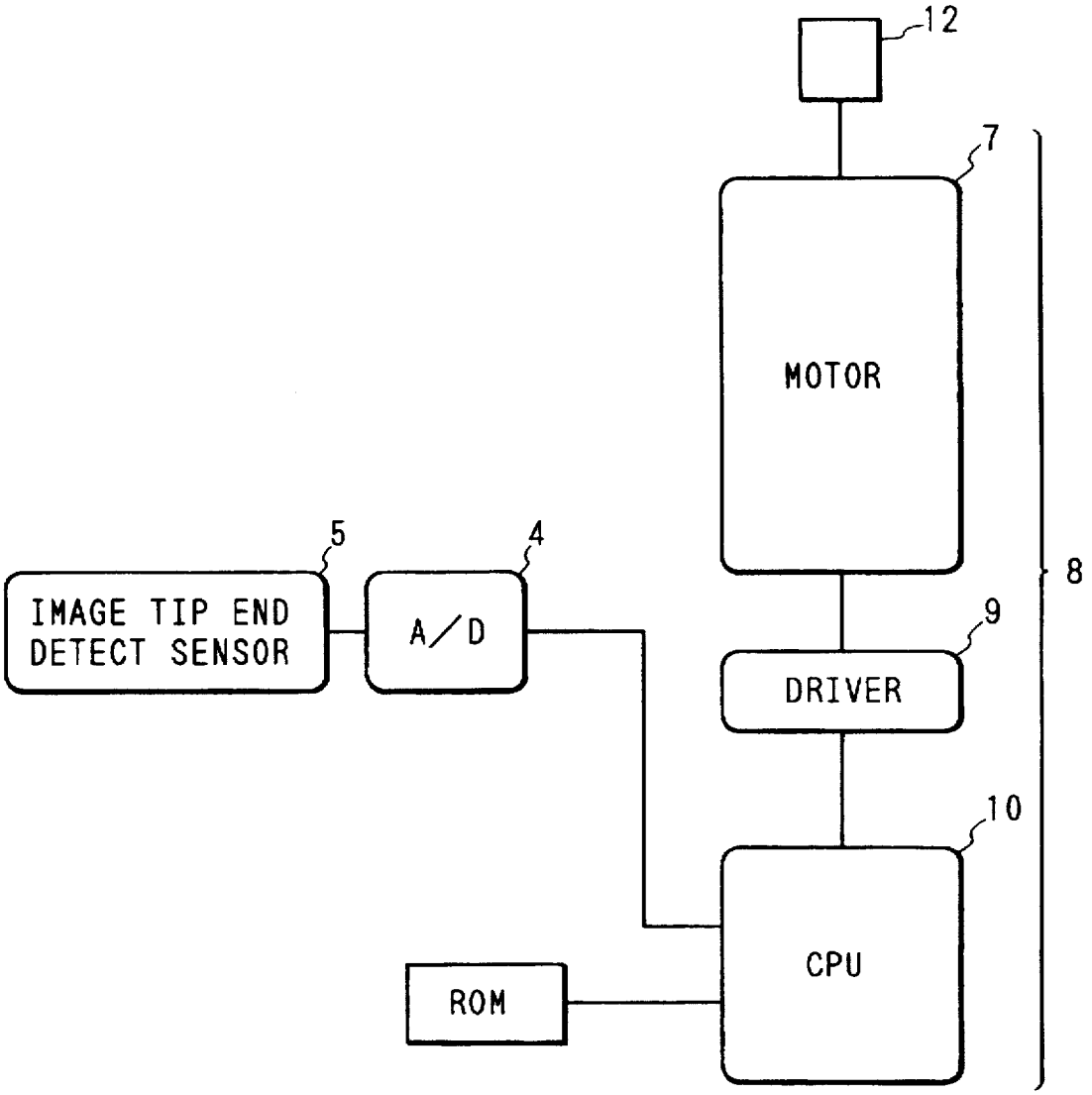
FIG. 2 is a block diagram of a control mechanism for controlling a rotation of the transfer drum.

As shown in FIG. 2, the transfer drum 12 (and the image bearing member 13) are connected to a stepping motor 7, and the stepping motor 7 is connected to a control device (CPU) 10 via a driver 9. Further, the image tip end detection sensor 5 is connected to the control device 10 via an A/D converter 4. With this arrangement, the stepping motor 7 can switch the transfer drum 12 from the process speed $V_0$ to the process speed $V_1$ ($V_0 > V_1$) at a predetermined timing (described later) based on an output of the image tip end detection sensor 5 as a reference. Incidentally, the stepping motor 7, driver 9 and control device 10 constitute a drive control system 8.

Figure 3:
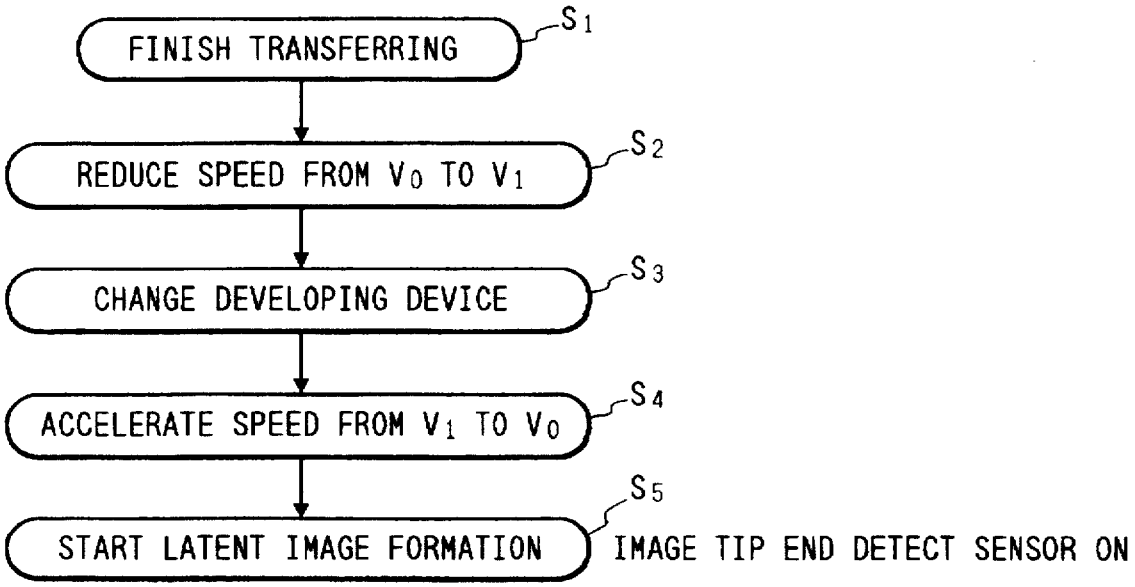
FIG. 3 is a flow chart showing the operation of the transfer drum.

Next, the switching between the process speeds $V_0$, $V_1$ will be explained with reference to FIG. 3. First of all, the image bearing member 13 and the transfer drum 12 are rotated at the process speed $V_0$ by means of the control device 10 (FIG. 2) and the stepping motor 7. The transfer material P onto which the toner image is to be transferred is held on the transfer drum 12. In this case, the transfer material P is held in such a manner that the image tip end $P_1$ (solid line in FIG. 1) is aligned with the flag 6. As the transfer drum 12 is rotated, when the flag 6 is detected by the image tip end detection sensor 5, the fact that the image tip end $P_1$ of the transfer material P reaches the image tip end detecting station S is detected (broken line in FIG. 1). In this case, in response to an image tip end detection signal for a first color (for example, yellow) outputted from the image tip end detection sensor 5, the latent image formation on the image bearing member 13 is started at the latent image forming station C. While the image tip end $P_1$ of the transfer material P is being shifted by the distance between the image tip end detecting station S and the transfer station T, the latent image formed at the latent image forming station C is shifted by the distance $L_4$ to reach the developing station D, where the toner is adhered to the latent image to form the toner image. Then, the toner image is shifted by the distance $L_5$ to reach the transfer station T. Thus, in the transfer station T, the image tip end $P_1$ of the transfer material P is aligned with the tip end of the toner image.

While the transfer material P is being shifted from the position where the image tip end $P_1$ is aligned with the transfer station T to the position where the image trail end $P_2$ has passed through the transfer station T, the toner image is transferred onto the transfer material P regarding the entire length $L_0$ thereof. After the image tip end $P_1$ of the transfer material P passes through the image tip end detecting station S, while the transfer material is being shifted until the image trail end $P_2$ has just passed through the transfer station T, (i.e., while the transfer drum 12 is rotated by the distances $L_2$, $L_0$), the transfer drum 12 and the image bearing member 13 are rotated at the process speed of $V_0$. The time period of this rotation becomes $(L_2+L_0)/V_0$.

After this time period is elapsed, i.e., after the transferring operation is finished (step $S_1$ in FIG. 3), the rotational speed of the stepping motor 7 is reduced so that the process speed of the transfer drum 12 and the image bearing member 13 is decreased to $V_1$ (step $S_2$). Then, the developing unit switching operation is started and the developing unit switching operation is finished within a time period of $L_3/V_1$ (step $S_3$). After the developing unit switching operation is finished, the process speed is accelerated from $V_1$ to $V_0$ (initial speed) (step $S_4$), and, when a next image tip end $P_1$ is detected by the image tip end detection sensor 5, the series of processes starting from the latent image formation are repeated (step $S_5$).

Next, the illustrated embodiment will be described referring to a concrete example.

As a comparison example, a diameter of the transfer drum 12 was set to 160 mm, a diameter of the image bearing member 13 was set to 40 mm, an angular distance between the latent image forming station C and the transfer station T was set to 180°, a length $L_0$ of the maximum available transfer material P (REGAL size) in the conveying direction was set to 356 mm, and the process speed $V_0$ was set to 100 mm/sec (constant). In this case, the developing unit switching operation is effected for the following time period calculated from the above-mentioned equations (1) and (2):

$$\{160\eta-(356+40\eta\times180°/360°)\}/100=0.838 \text{ sec.}$$

In the illustrated embodiment, the developing unit switching operation is effected for a time period of 0.838 second, as is in the comparison example, and, when a diameter of the image bearing member 13 is 40 mm, an angular distance between the latent image forming station C and the transfer station T is 180°, a length $L_0$ of the maximum available transfer material P (REGAL size) in the conveying direction is 356 mm, and the process speed $V_0$ during the transferring operation is 100 mm/sec and the process speed during the developing unit switching operation is 20 mm/sec, a diameter of the transfer drum 12 can be set as follows:

$$(0.838\times20+356+40\eta\times180°/360°)/\eta=138.7 \text{ mm.}$$

Accordingly, in comparison with the comparison example, the diameter of the transfer drum 12 can be reduced by 21.3 mm.

Further, by setting the process speed $V_1$ to zero, the diameter of the transfer drum 12 can be further reduced.

Further, in the illustrated embodiment, when the diameter of the transfer drum 12 is set to 160 mm as is in the comparison example, the developing unit switching operation may be effected for a time period of 4.19 sec (=0.838×100/20), and, thus, the developing unit switching time $T_0$ can be reserved sufficiently. Further, when the developing unit switching operation can be effected for the time period of 0.838 sec, by selecting the diameter of the transfer drum 12 to 160 mm and selecting the process speeds $V_0$, $V_1$ to 200, 100 mm/sec, respectively (the process speed during the transferring operation is twice the process speed during the developing unit switching operation), a recording speed may be increased.

In this way, in the illustrated embodiment, by reducing the process speed of the transfer drum 12 rotated by the switching distance $L_3$ from $V_0$ to $V_1$, the peripheral length (and, thus, diameter) of the transfer drum 12 can be reduced, thereby making the entire apparatus compact.

Further, in the image forming apparatus according to the illustrated embodiment, by manipulating a mode switching switch provided on an operation panel, a mono-color mode, a two-color mode, a three-color mode or a full-color mode can be selected. That is to say, in the image forming apparatus according to the illustrated embodiment, by selecting one of the above modes, the number of color images to be transferred to the transfer material P can be selected.

Accordingly, when the images are continuously formed on a plurality of transfer materials (continuous image formation) by inputting a single image formation start signal from the external device to the image forming apparatus in the mono-color mode, the developing unit switching operation is not effected. That is to say, the developing unit switching time is not required.

By the way, in the image forming apparatus according to the illustrated embodiment, since the diameter of the transfer drum 12 is reduced as mentioned above, only by effecting the continuous image formation in the mono-color mode without reducing the process speed of the transfer drum 12 from $V_0$ to $V_1$, the image forming time for forming the image on the predetermined number of transfer materials in the mono-color mode can be reduced in comparison with the above-mentioned comparison example.

Further, in the illustrated embodiment, while an example that the image is formed on the transfer material supported on the transfer drum 12 was explained, the present invention is not limited to this example, but can be applied to an image forming apparatus wherein an intermediate transfer drum is used in place of the transfer drum 12 of the first embodiment, and, after the images formed on the image bearing member 13 are directly transferred onto the intermediate transfer drum in a superimposed fashion, the images transferred to the intermediate transfer drum are collectively transferred onto a transfer material. In this case, the same advantage as that of the first embodiment can be achieved.

(Second Embodiment)

Figure 4:
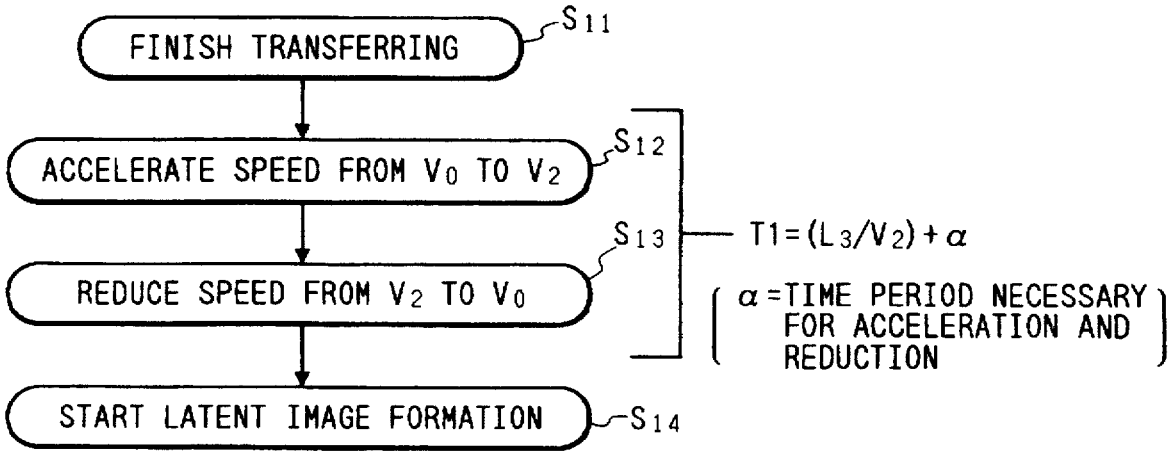
FIG. 4 is a flow chart showing an operation of an image bearing member according to a second embodiment of the present invention.

FIG. 4 shows a second embodiment which can be applied to the image forming apparatus of the first embodiment. As mentioned above, since the developing unit switching operation is not effected in the continuous image formation in the mono-color mode, the developing unit switching time $T_0$ is not required. Although the process speed of the transfer drum 12 is maintained to $V_0$ (constant) from the completion of the transferring operation to the start of the next latent image formation in the continuous image formation in the mono-color mode according to the first embodiment, in the second embodiment, after the transferring operation is finished (step $S_{11}$ in FIG. 4), the process speed is accelerated from $V_0$ to $V_2$ (step $S_{12}$) so that the developing unit switching time is reduced from $T_0$ to $T_1$ ($=L_3/V_2+\alpha$), thereby increasing the continuous mono-color image formation time to reduce the recording time. After the transfer drum is rotated by the distance $L_3$, the process speed of the transfer drum is reduced from $V_2$ to $V_0$ (step $S_{13}$), thereby preparation for the next latent image formation (step $S_{14}$). Incidentally, the above-mentioned value $\alpha$ is a time period required for acceleration and reduction.

(Third Embodiment)

Figure 10:
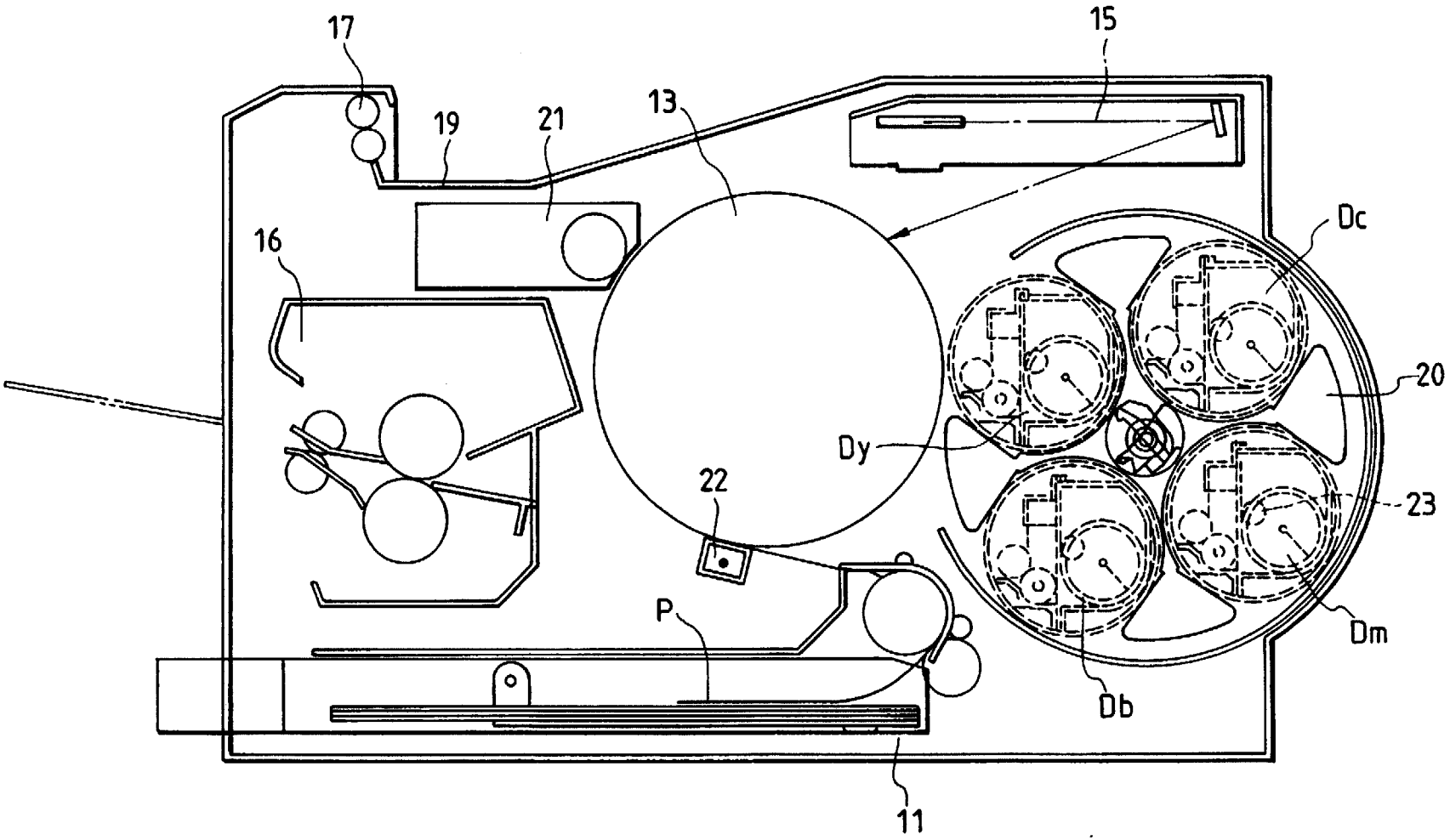
FIG. 10 is a schematic sectional view of a multi-color image forming apparatus of multi-development type.

FIG. 10 shows an image forming apparatus of multi-development type according to a third embodiment of the present invention. Latent images for respective colors successively formed on an image bearing member 13 by an optical unit 15 are developed with color toner by respective color developing units Dy, Dc, Dm and Db to form toner images. As a result, four color toner images are born on the image bearing member 13 in a superimposed fashion. On the other hand, a transfer material P is supplied from a sheet supply portion 11, and the toner images on the image bearing member 13 are collectively transferred onto the transfer material P at a transfer station 22. Thereafter, the transfer material P is sent to a fixing device 16, where the toner images are fixed to the transfer material. Then, the transfer material is discharged onto a sheet discharge tray 19 by means of a pair of discharge rollers 17.

By the way, as is in the first embodiment, each of the developing units Dy, Dc, Dm and Db is provided at its both ends with rotation shafts 23 so that each developing unit is held by a developing unit switching mechanism 20 for rotation around the rotation shafts of the unit. In a developing operation, a selected developing unit is brought to a developing station by rotation of the developing unit switching mechanism 20.

By the way, there is a danger of distortion of an image due to shock, vibration or the like generated by the developing unit switching operation. To avoid this, in the illustrated embodiment, the developing unit switching operation is not effected when the latent image is being formed by the optical system 15.

Figure 5:
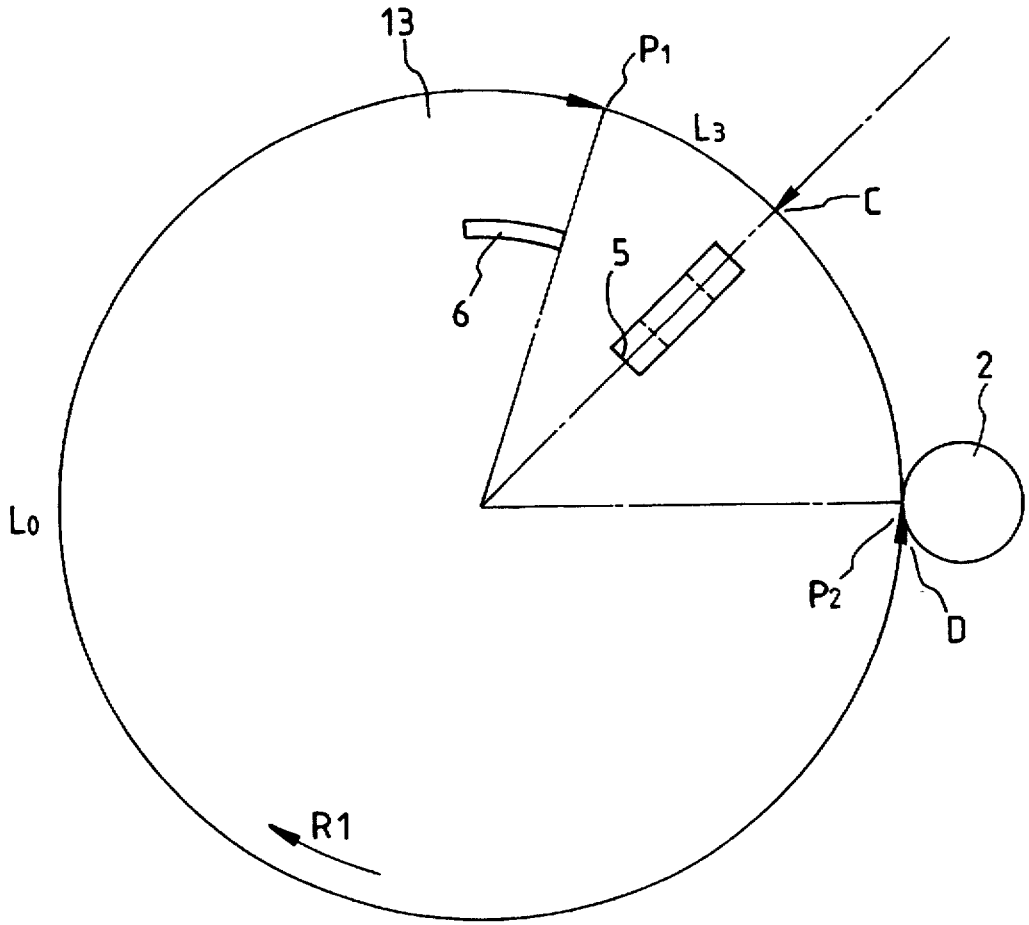
FIG. 5 is a sectional view for explaining operations of an image bearing member and a developing roller, according to a third embodiment of the present invention.
Figure 6:
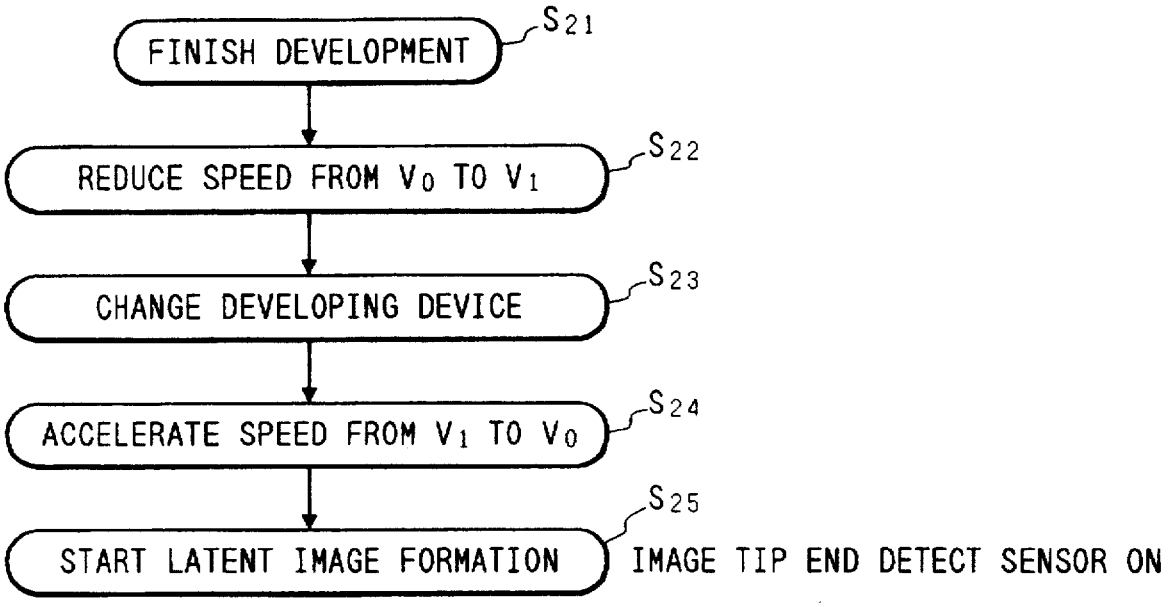
FIG. 6 is a flow chart showing an operation of the image bearing member of FIG. 5.

That is to say, in FIG. 5, a switching length $L_3$ is provided between an image tip end $P_1$ positioned when an image trail end $P_2$ on the image bearing member 13 has just passed through the developing station D and the latent image forming station C. A condition for preventing the developing unit switching operation from affecting a bad influence upon the image is that the developing unit switching operation is effected within a time period during which the image bearing member 13 is rotated by the switching length or distance $L_3$. To satisfy this condition, as soon as the developing operation is finished (step $S_{21}$ in FIG. 6), the process speed is reduced from $V_0$ to $V_1$ (step $S_{22}$), and, then, when the developing unit switching operation is finished (step $S_{23}$), the process speed is returned from $V_1$ to $V_0$ (step $S_{24}$), and then the next latent image formation is started (step $S_{25}$). In this way, a peripheral length of the image bearing member 13 can be reduced by an amount corresponding to $T_0$ $(V_0-V_1)$. Further, $V_1$ may be zero ($V_1=0$). In this case, the developing unit switching or changing operation is effected in a condition that the image tip end $P_1$ is stopped immediately before the latent image forming station C.

Next, the third embodiment will be described referring to a concrete example.

As a comparison example, a length $L_0$ of the transfer material P in the conveying direction was set to 356 mm, a diameter of the image bearing member 13 was set to 150 mm, and a distance between the latent image forming station C and the developing station D along the periphery of the image bearing member 13 was set to 25 mm. Accordingly, the length $L_3$ becomes 90.2 mm. Now, when the speed $V_0$ is set to 100 mm/sec (constant), the developing unit switching operation is effected within a time period of about 0.9 second.

To the contrary, in the illustrated embodiment, when the process speed $V_1$ during the developing unit switching operation is 20 mm/sec, if the developing unit switching operation is effected for a time period of about 0.9 second as is in the comparison example, the diameter of the image bearing member becomes:

$$(356+25+20\times0.9)/\eta=127 \text{ mm}.$$

Thus, the diameter of the image bearing member can be reduced from 150 mm (comparison example) to 127 mm.

Further, when $V_1=0$, the diameter of the image bearing member 13 can be further reduced as follows:

$$(356+25)/\eta=121.3 \text{ mm}.$$

(Fourth Embodiment)

Figure 7:
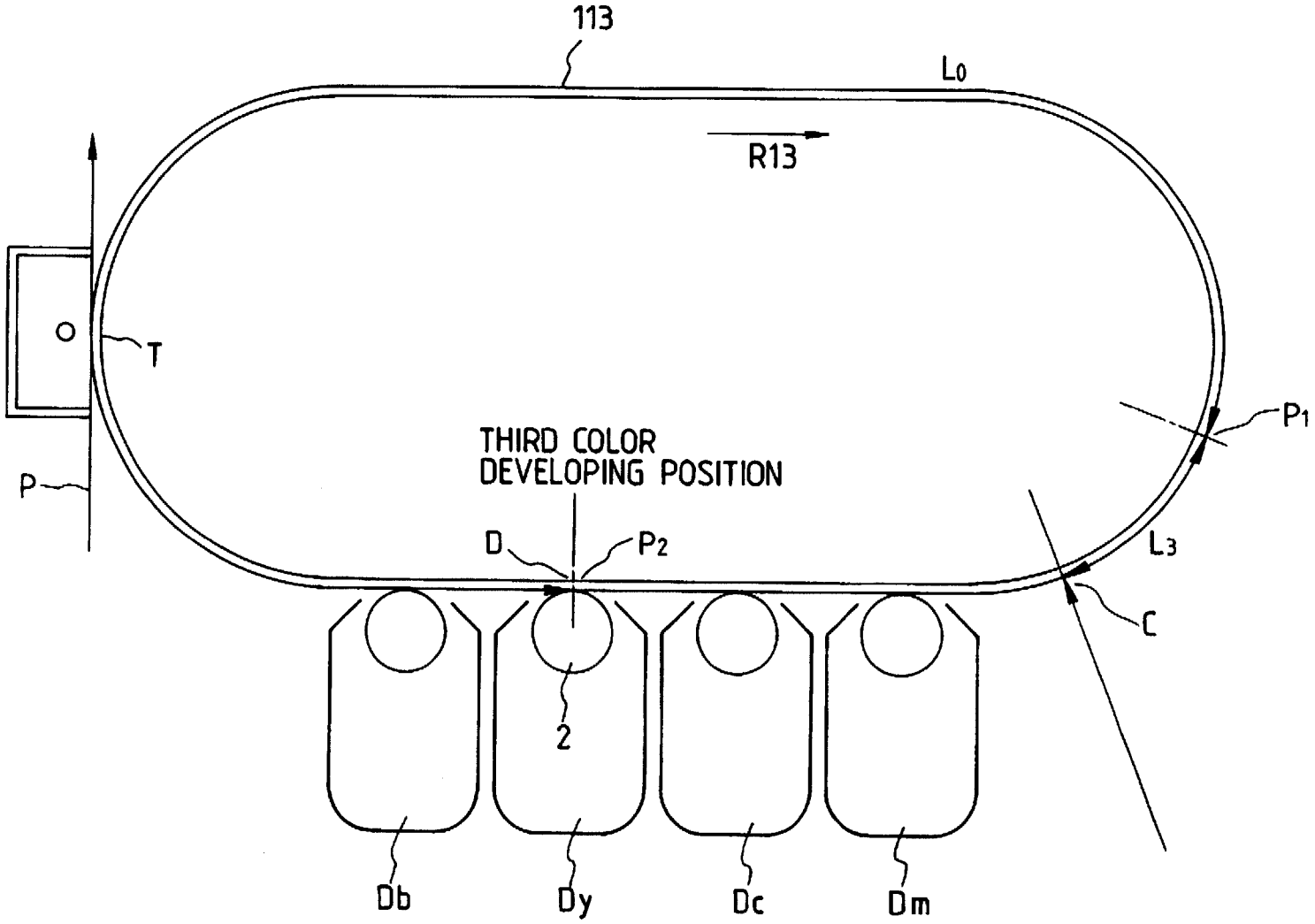
FIG. 7 is a sectional view for explaining operations of a developing unit, and a photosensitive belt according to a fourth embodiment of the present invention.

FIG. 7 shows an image forming apparatus of multi-development type according to a fourth embodiment of the present invention. Four developing units Dm, Dc, Dy and Db are arranged around a photosensitive belt 113 along a rotational direction (shown by the arrow R13) of the belt. Whenever the developing operation is effected, the developing units are successively (Dm, Dc, Dy and Db in order) positioned with respect to the photosensitive belt 113. The developing units Dm, Dc, Dy, Db are driven by a common drive source so that one of the four developing units is selectively switched to the operating position.

When the third color developing operation is finished, i.e., when the image trail end $P_2$ is aligned with the developing station D where the developing roller 2 of the developing unit Dy is contacted with the photosensitive belt 113, a length $L_3$ between the image tip end $P_1$ and the latent image forming station C is required for switching or changing from the developing unit Dy to the developing unit Db. Thus, as is in the third embodiment, by reducing the process speed when the latent image is not being formed, the switching length $L_3$ can be reduced.

Now, this embodiment will be described referring to a concrete example. As a comparison example, if the process speed V is 100 mm/sec (constant), when a maximum length of a transfer material P available to the apparatus of FIG. 7 in the conveying direction is 356 mm and a time period required for changing the developing unit from an inoperative condition to an operative condition is 0.5 sec, an entire length of the belt 113 becomes as follows:

$$356+100\times0.5+\widehat{CDy}=406+\widehat{CDy} \text{ (mm)}.$$

In the illustrated embodiment, by reducing the process speed to $V_1$ (20 mm/sec) during the developing unit switching operation, the entire length of the belt 113 can be reduced to:

$$356+20\times0.5+\widehat{CDy}=366+\widehat{CDy} \text{ (mm)}.$$

Further, when $V_1=0$, the entire length of the belt 113 can be further reduced to $$356+\widehat{CDy} \text{ (mm)}.$$

(Fifth Embodiment)

Figure 8:
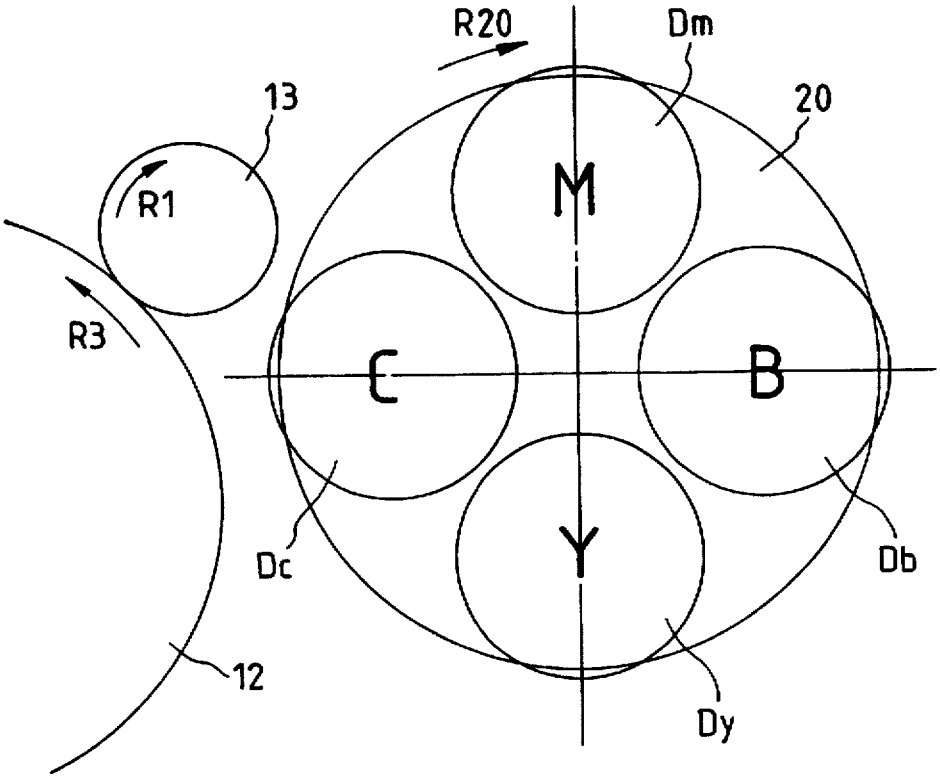
FIG. 8 is a sectional view for explaining operations of an image bearing member, a developing unit and a transfer drum, according to a fifth embodiment of the present invention.

Next, a fifth embodiment of the present invention which can be applied to the apparatus of the first embodiment will be explained with reference to FIG. 8.

When a full-color image is formed, the developing units are successively switched (in order of Dm→Dc→Dy→Db) by rotating the developing unit switching mechanism 20 in a direction shown by the arrow R20. In this case, in accordance with the kind of an image, one or two color development(s) can be omitted. However, as shown in the first embodiment, the rotation of the transfer drum 12 is set on the basis of the switching time period for switching the developing units successively (for example, a time period required for changing a certain developing unit Dm to an adjacent developing unit Dy). Thus, conventionally, the developing unit switching operations were successively effected even when the unnecessary development(s) is included. That is to say, idle rotation of the transfer drum 12 (during which the transferring operation is not effected) was required for switching the unnecessary developing unit.

In the first embodiment, while the process speed is reduced from $V_0$ to $V_1$ when a certain developing unit is changed to an adjacent developing unit, in the fifth embodiment, when one of the developing units is skipped (for example, when the developing unit Dm is changed to the developing unit Dy), the process speed is reduced from $V_0$ to $V_1/2$, and, when two of the developing units are skipped (for example, when the developing unit Dm is changed to the developing unit Db), the process speed is reduced from $V_0$ to $V_1/3$, thereby increasing the image forming speed for the non full-color image.

That is to say, since the process speeds of the transfer drum 12 and the image bearing member 13 can be set in three or more stages, the entire image forming speed can be increased.

What is claimed is:

1. An image forming apparatus comprising:

an image bearing member for bearing an image;

an image forming means for forming the image on said image bearing member;

a movable member which can be shifted along a transfer station of said image bearing member and onto which a first image and a second image on said image bearing member are successively transferred in a superimposed fashion;

a developing device switching means for switching one developing device effecting a developing operation to the other developing device not effecting the developing operation, among a plurality of developing devices;

a shifting speed switching means for switching a shifting speed of said movable member between a first shifting speed during a transferring operation and a second shifting speed slower than the first shifting speed after the first image was transferred to said movable member and before the second image is transferred onto said movable member, wherein a first mode in which the switching operation of said developing device switching means is effected and a second mode in which the switching operation of said developing device switching means is not effected can be selected when the image is formed on a single transfer material, and when said second mode is selected, said movable member is not switched from the first shifting speed to the second shifting speed.

2. An image forming apparatus according to claim 1, wherein said image forming means includes a latent image forming means for forming first and second latent images on said image bearing member, a first developing device for developing the first latent image at a developing station of said image bearing member to form the first image, a second developing device for developing the second latent image at the developing station of said image bearing member to form the second image, and said developing device switching means switches the first developing device and the second developing device selectively, relative to the developing station.

3. An image forming apparatus according to claim 2, wherein there is a time period for shifting said movable member at the second shifting speed, between a time when a surface of said photosensitive member positioned at the developing station upon starting of a switching operation of said developing device switching means has just passed through the transfer station and a time when a surface of said photosensitive member positioned at the developing station upon completion of the switching operation of said developing device switching means has just passed through the transfer station.

4. An image forming apparatus according to claim 2, wherein said developing device switching means switches said developing devices within a time period from when the first image was transferred to said movable member to when the formation of the second latent image is started by said latent image forming means.

5. An image forming apparatus according to claim 4, wherein there is a time period for shifting said movable member at the second shifting speed during the switching operation of said developing device switching means.

6. An image forming apparatus according to claim 3, wherein said developing device switching means switches said developing devices within a time period from when the first image was transferred to said movable member to when the formation of the second latent image is started by said latent image forming means.

7. An image forming apparatus according to claim 6, wherein there is a time period for shifting said movable member at the second shifting speed during the switching operation of said developing device switching means.

8. An image forming apparatus according to claim 3, wherein said movable member conveys the transfer material to the transfer station while bearing said transfer material, and the image on said image bearing member is transferred onto said transfer material born on said movable member.

9. An image forming apparatus according to claim 7, wherein said movable member conveys the transfer material to said transfer station while bearing said transfer material, and the image on said image bearing member is transferred onto said transfer material born on said movable member.

10. An image forming apparatus according to claim 8 or 9, further comprising a detection means for detecting a tip end of the transfer material born on said movable member in a shifting direction of said transfer material, and a time for starting an operation of said latent image forming means is determined on the basis of a detected result from said detection means.

11. An image forming apparatus according to claim 2, wherein, when the images are continuously transferred onto a plurality of transfer materials in response to a single image formation start signal in said second mode, the shifting speed of said movable member is switched to a third shifting speed faster than said first shifting speed after the image was transferred to the transfer material before a next image is transferred onto the transfer material.

12. An image forming apparatus according to claim 3 or 7, wherein said image forming means has a third developing device, and said developing device switching means selectively switches said first, second and third developing devices to said developing station.

13. An image forming apparatus according to claim 12, wherein the switching time period for switching from said first developing device to said second developing device differs from the switching time period for switching from said first developing device to said third developing device, and a magnitude of said second shifting speed is determined on the basis of the switching time period for the developing device.

14. An image forming apparatus according to claim 1, wherein said second shifting speed is zero.

15. An image forming apparatus comprising:

a movable image bearing member for bearing an image thereon;

a plurality of developing means for developing on said image bearing, at one developing position, a first image and a second image of different color from the first image sequentially and superimposedly, one of said plural developing means being selectively switched to the developing position; and a shifting speed switching means for switching a shifting speed of said image bearing member between a first shifting speed during the image formation and a second shifting speed slower than said first shifting speed, after the first image was formed on said image bearing member and before the second image is formed on said image bearing member.

16. An image forming apparatus according to claim 15, wherein said image forming means comprises a latent image forming means for forming first and second latent images on said image bearing member, a first developing device for developing the first latent image at a developing station of said image bearing member to form said first image, a second developing device for developing the second latent image at the developing station of said image bearing member to form said second image, and a developing device switching means for selectively switching said first and second developing devices to a development operating condition.

17. An image forming apparatus according to claim 16, wherein said developing device switching means switches said developing devices within a time period from when an operation of said first developing device is finished to when the formation of the second latent image is started by said latent image forming means.

18. An image forming apparatus according to claim 17, wherein there is a time period for shifting said image bearing member at the second shifting speed during the switching operation of said developing device switching means.

19. An image forming apparatus according to claim 15, wherein said second shifting speed is zero.

20. An image forming apparatus according to claim 16, wherein the images formed on said image bearing member in the superimposed fashion are collectively transferred onto a transfer material.

21. An image forming apparatus comprising:

an image bearing member for bearing an image thereon;

an image forming means for forming the image on said image bearing member, said image forming means includes a plurality of developing devices for forming images of different colors on said image bearing member;

a rotatable transfer material bearing member for bearing a transfer material thereon, the image being transferred to the transfer material born on said transfer material bearing member from said image bearing member at a transfer station, an image of first color and a image of second color of said image bearing member capable of being superimposedly transferred to the transfer material born on said transfer material bearing member; and a rotary speed switching means for switching a rotary speed of said transfer material bearing member between a first rotary speed and a second rotary speed slower than it;

wherein said image forming apparatus capable of selecting a first mode in which the image of plural colors is formed on single transfer material or a second mode in which the image of single color is formed on single transfer material, and wherein in the first mode said transfer material bearing member is in the first rotary speed during the image transfer operation, and whose rotary speed is switched to the second rotary speed after the image of first color is transferred to the transfer material born on said transfer material bearing member and before the image of second color is not transferred thereto; and in the second mode after the image transfer operation the rotary speed of said transfer material bearing member is not switched from the first rotary speed to the second rotary speed.

22. An image forming apparatus according to claim 21, wherein when the image is transferred to a plurality of transfer materials in the second mode, said rotary speed switching means can switch the rotary speed of said transfer material bearing member to a third rotary speed faster than the first rotary speed, after completion of the image transfer to one transfer material before start of the image transfer to another material.

23. An image forming apparatus according to claim 21, wherein said plurality of developing devices includes a first developing device for effecting the developing operation for the image of first color, and a second developing device for effecting the developing operation for the image of second color, and a distance to be moved by said image bearing member during switching from the first developing device to the second developing device is larger than length of an area on said transfer material bearing member in a rotational direction thereof where the transfer material is not born.

24. An image forming apparatus according to claim 23, wherein after a part of said image bearing member positioned at the developing station passes by the transfer station upon the start of switching operation from the first developing device to the second developing device, and before the part of said image bearing member positioned at the developing station passes by the transfer station upon completion of switching operation from the first developing device to the second developing device, there exists a time period in which said transfer material bearing member rotates in the second rotary speed.

* * * * *

UNITED STATES PATENT AND TRADEMARK OFFICE

CERTIFICATE OF CORRECTION

PATENT NO. : 5,781,826

DATED : July 14, 1998

INVENTOR(S) : MITSUGU INOMATA

It is certified that error appears in the above-identified patent and that said Letters Patent is hereby corrected as shown below:

COLUMN 6,
Line 33, "{160 η- (356 + 40 η" should read --{160 π- (356 + 40π--; and
Line 48, "40 η x 180°/360°)/ η" should read --40π x 180°/360°)/π--.

COLUMN 9,
Line 1, "η =" should read --π=--; and
Line 7, "η =" should read --π=--.

COLUMN 11,
Line 47, "2," should read --1,--.

COLUMN 12,
Line 58, "a" should read --an--.

Signed and Sealed this

Sixteenth Day of March, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,781,826

DATED : July 14, 1998

INVENTOR : MITSUGU INOMATA

It is certified that error appears in the above-identified patent and that said Letters Patent is hereby corrected as shown below:

COLUMN 11,
Lines 2 and 6, change "photosensitive" to --image bearing--.

COLUMN 12,
Line 7, after "image bearing" insert --member--.

Signed and Sealed this

Twentieth Day of April, 1999

*Attest:*

Q. TODD DICKINSON

*Attesting Officer*

*Acting Commissioner of Patents and Trademarks*